US008246315B2

(12) United States Patent
Brown

(10) Patent No.: US 8,246,315 B2
(45) Date of Patent: Aug. 21, 2012

(54) DRIP PUMP SYSTEM

(76) Inventor: T. Leon Brown, Amarillo, TX (US)

( * ) Notice: Subject to any disclaimer, the term of this patent is extended or adjusted under 35 U.S.C. 154(b) by 933 days.

(21) Appl. No.: 12/260,737

(22) Filed: Oct. 29, 2008

(65) Prior Publication Data

US 2010/0104451 A1 Apr. 29, 2010

(51) Int. Cl.
*F04F 5/46* (2006.01)

(52) U.S. Cl. ..... 417/54; 166/105.5

(58) Field of Classification Search ..... 166/105.5; 96/396; 417/54, 390, 398
See application file for complete search history.

(56) References Cited

U.S. PATENT DOCUMENTS 4,320,799 A * 3/1982 Gilbertson ..... 166/68.5
6,585,049 B2 * 7/2003 Leniek, Sr. ..... 166/369
2005/0226752 A1 10/2005 Brown
2006/0171821 A1 8/2006 Brown
2006/0254777 A1 * 11/2006 Wynn ..... 166/369
2007/0154324 A1 * 7/2007 Williams ..... 417/53

* cited by examiner

*Primary Examiner* — Anne Hines
(74) *Attorney, Agent, or Firm* — Gable Gotwals

(57) ABSTRACT

A system and method for pumping an underground drip includes a pump barrel housing with a plunger and an elongated stroke actuator cylinder sealed to the pump barrel that vertically reciprocates the plunger. The pump barrel and plunger are preferably vented to avoid vacuum lock during pumping. The plunger pumps the fluid located in the drip upwardly to a low pressure tank or a pressurized surface vessel. A ball valve may be screwed onto the siphon line to allow for insertion and removal of the pump barrel and seals the siphon line if the pump is removed. A stuffing box seals the pump barrel to the upper end of the siphon line to prevent air from entering the system. The stuffing box also allows the pump depth to be easily adjustable by sliding the pump in until the pump tags bottom and then tightening at any point needed.

17 Claims, 7 Drawing Sheets

FROM 120
14
44
40
38
P
58
97
96
54
84
92
82
94
88
72
76
12
110
78

DRIP PUMP SYSTEM

FIELD OF INVENTION

This invention relates generally to gas gathering and transportation systems and, in particular, the extraction of fluid out of gas gathering and transportation pipelines.

BACKGROUND OF THE INVENTION

In gas gathering and transportation systems, fluid in pipelines has been a constant source of problems and expense. In depleted fields in particular, where wells must be pulled down to a few pounds or a vacuum to maintain production, the problem is worse. For many years the amount of vacuum was limited due to the use of compressors which leak oxygen past mechanical seals and rings. The advent of liquid ring and rotary liquid screw type compressors supplied the industry with the ability to increase production in the Panhandle West gas fields, and many other fields, by reducing the pressure below atmospheric without introducing oxygen into the system. Over the past 20 years this has led to entire fields involving thousands of wells which must be kept at various vacuums, with many at 22", which is close to the maximum that can be reached at the elevation of the Panhandle West fields.

A method to extract fluid out of these lines has remained many years behind the technology used to place them in the existing situation. As the secondary recovery technique progressed, the time increased for wells and gathering lines to pressure up and blow the fluid out of the drips when the compressors were shut down or bypassed. (A "drip" is typically an underground vessel designed to catch and hold fluids which drop out of natural gas during transportation through pipelines). Over the past several years the situation has evolved into a major problem. Drip trucks cannot pull fluid out unless the system is vented or left down for long periods of time in order to lower the amount of vacuum. In many cases entire sections of a field involving several wells must be shut down and lines allowed to suck in air. After a point is reached where a truck can empty the drip, the wells are opened and lines purged to atmosphere to evacuate the oxygen which was sucked in.

The wasted power for compressors, the amount of gas lost with air during the purging process, and the hours of trucking cost and down time are unacceptable. The danger of environmental impact problems due to the wasted natural gas is increasing because the oxygen tends to lay in the low parts of the lines and a large amount of gas must be vented to attain the 50 ppm or less oxygen content required to enter the pipeline system and resume normal production delivery. Many of these wells will not return to positive pressure in several months or years. Even in newer wells, gas is wasted and the environment is impacted as thousands of mcf are lost daily to the atmosphere when vacuum trucks or gear type pumps are used to load the drip trucks.

One of the insurmountable problems with all prior art is the mixture of the fluid in these drips. The fluid is a high gravity condensate mixed in various degrees of percentage with water. Pumps used to move normal liquefied petroleum gas or Y-Grade products are damaged or unsuitable for moving water and heavier liquids. Pumps used to move fluids are not capable of moving the Y-Grade type hydrocarbons. Vacuum type pumps are limited to the same or less vacuum capability as the elevation of the gathering system.

BRIEF SUMMARY OF THE INVENTION

Figure 1:
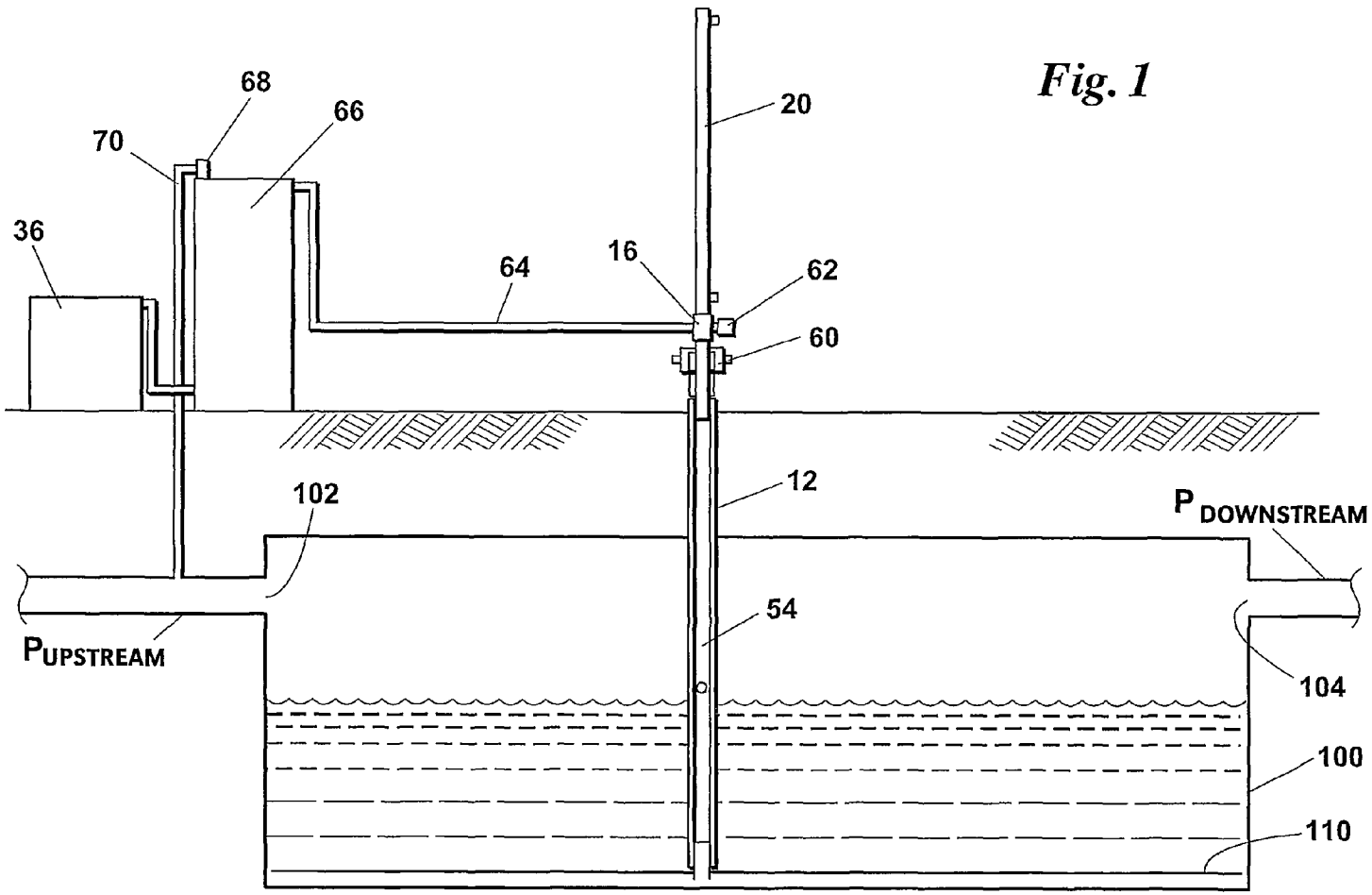
FIG. 1 is view of a closed system for pumping fluid from an underground drip. A pump barrel is in communication with a fluid collecting within the underground drip. A stuffing box helps provide for vertical adjustment of the pump barrel so that the nipple end of the pump tags a bottom of the drip. A vertically positioned elongated stroke actuator cylinder supported above the pump barrel actuates a piston in communication with the pump plunger to force fluid upward into a tee fitting and to a collection vessel.

A system and method for pumping fluid out of an underground drip includes a pump barrel in communication with a fluid collecting within the underground drip. The drip may have a positive pressure or may have a vacuum within. A vertically positioned elongated stroke actuator cylinder is supported above the pump barrel and in alignment therewith.

The pump barrel may be located within a portion of an existing siphon line. The system may also include a ball valve that receives the pump barrel and sealably closes access to an upper end of the siphon line. The pump barrel may also have at least one vent port and include a plunger having at least one vent hole and one or more traveling valves.

The stroke actuator cylinder may be a hydraulic cylinder, an air cylinder, a vacuum cylinder, an electric cylinder, or an electromagnetic cylinder, and includes a vertically displaceable piston that is in communication with the pump plunger. The stroke actuator cylinder may also include a seal member affixed to a lower end of the cylinder for sealably and reciprocally receiving a piston rod.

A power system powers the stroke actuator cylinder to vertically reciprocate the piston and thereby the plunger. Fluid flows upwardly under pressure through a passageway formed by the pump barrel and into a tee fitting vertical passageway and out through the tee fitting side opening to a collection vessel. The collection vessel may be a low pressure tank or a surface pressurized tank and may have a vapor return line in communication with the underground drip. The pump, stroke actuator cylinder, tee fitting, and collection vessel form a closed system. A water collection tank may also be included.

The system may include a stuffing box that allows for vertical height adjustment of the pump barrel and piping. The stuffing box is mounted on the siphon line and then the pump barrel is inserted through the siphon line until the straining nipple of the pump tags a bottom portion of the drip. Stuffing box is then tightened to seal the pump barrel to the siphon line to prevent air from entering the drip.

The method of pumping the underground drip includes the step of inserting the pump barrel into the drip until the straining nipple end of the pump barrel tags a bottom portion of the drip. The pump barrel is sealed at an upper end and the elongated stroke actuator cylinder is positioned and sealed above and in alignment with the pump barrel. A collection vessel is connected to a tee fitting in communication with the pump barrel. A plunger within the pump barrel is then sequentially vertically manipulated by the stroke actuator cylinder to pump fluid located within the underground drip to the collection vessel.

The method may also include the step of inserting and passing the pump barrel through an open ball valve attached to an upper end of a siphon line. The pump barrel may then be removed from the siphon line and the ball valve closed. A draining step may be accomplished by a tee with a valve located below the ball valve.

DETAILED DESCRIPTION OF THE PREFERRED EMBODIMENTS

Elements of the preferred embodiments illustrated by the drawings and described herein are referenced by the following numbers:

| | |
|---|---|
| 10 | Drip pumping system |
| 12 | Siphon line |
| 14 | Ball valve |
| 16 | Fluid outlet tee |
| 17 | Thread adaptor |
| 18 | Top of 16 |
| 20 | Stroke actuator cylinder |
| 22 | Top end |
| 24 | Bottom end |
| 26 | Piston |
| 28 | Interior wall |
| 30 | Piston rod |
| 32 | Seal member |
| 34 | Closure member |
| 36 | Water tank |
| 38 | Hydraulic fluid pump |
| 40 | Pipe |
| 42 | Inlet opening |
| 44 | Return pipe |
| 45 | Outlet opening |
| 46 | Prime mover |
| 48 | Battery |
| 50 | Hydraulic control |
| 52 | Vertical passageway |
| 54 | Pump |
| 56 | Side opening |
| 58 | Rod |
| 60 | Stuffing box |
| 62 | Valve and gauge |
| 64 | Collection line |
| 66 | Collection vessel |
| 68 | Back pressure valve |
| 70 | Return line |
| 72 | Pump barrel |
| 74 | Lower end |
| 76 | Standing valve |
| 78 | Straining nipple |
| 82 | Traveling valve |
| 84 | Traveling valve |
| 88 | Vent |
| 92 | Plunger |
| 94 | Lower portion |
| 96 | Upper portion |
| 97 | Plunger tube |
| 98 | Vent hole |
| 100 | Drip |
| 102 | Inlet end |
| 104 | Outlet end |
| 106 | Low point in pipeline P |

-continued

| | |
|---|---|
| 108 | Pipe |
| 110 | Bottom portion of 100 |
| 112 | Solar panel |
| 114 | Pumping tee & valving |
| 116 | Hammer union half |
| 118 | Half-union |
| 120 | Nipple |
| 122 | Nipple |

Figure 2:
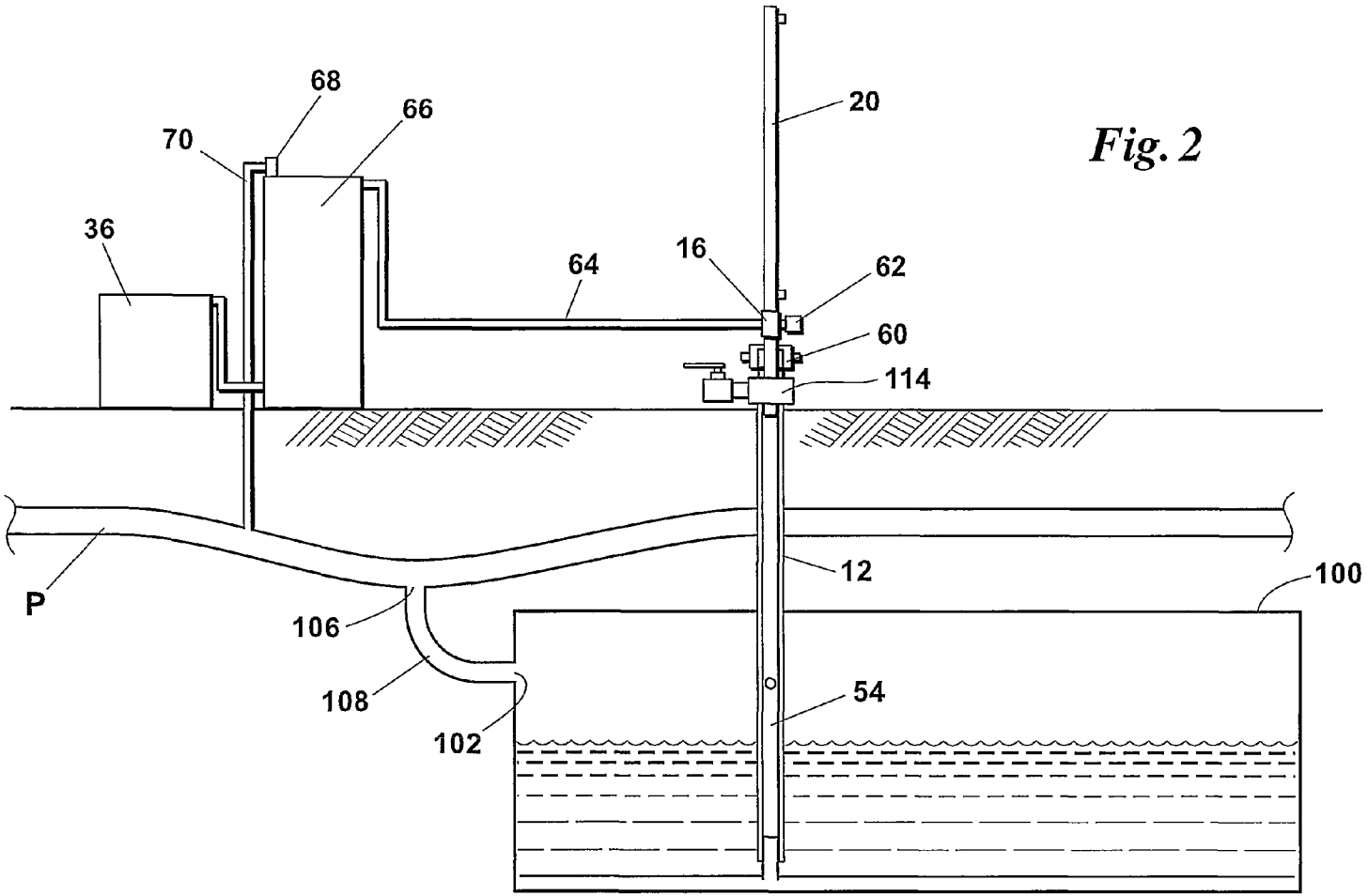
FIG. 2 is a view of the pumping system in which a pumping tee is screwed directly to the siphon line. Valving on the pumping tee allows the drip to be sucked out or blown in a normal way if the pump is not working.

Referring first to FIGS. 1 and 2, pumping system 10 includes a stroke actuator cylinder 20 in communication with a pump 54. Stroke actuator cylinder 20 is preferably a non-vented hydraulic cylinder similar to the hydraulic cylinder disclosed in my U.S. patent application Ser. No. 11/103,067, filed on Apr. 11, 2005 (U.S. Patent Application Pub. No. 2006/0171821, published Aug. 3, 2006), but may be an air, gas, vacuum, or non-hydraulic fluid linear actuator. Pump 54 may be inserted into siphon line 12, which has its lower end located at a bottom portion 110 of drip 100. Alternatively, pump 54 may be inserted through a fitting with no siphon line 12 or pipe extending to drip 100. The pump barrel 72 (see FIG. 3) replaces the need for siphon line 12 other than for blowing drip 100 if pump 54 is removed for a period of time.

Pump 54 may be a standard tubing pump or an insert pump but is preferably a gas vent pump as disclosed my U.S. patent application Ser. No. 11/092,258, filed Mar. 29, 2005 (U.S. Patent Application Pub. No. 2005/0226752, published Oct. 13, 2005). Pump 54 includes a pump barrel 72 and a plunger 92. Plunger 92, which is of a type well-known in the art, contains one or more traveling valves 82, 84 and pump barrel 72 contains a standing valve 76. See FIGS. 3 & 4. In a preferred embodiment, plunger 92 is a metal plunger, however, because of the relatively low load on pump 54, lower plunger portion 94 and upper plunger portion 96 are preferably elastomeric cup-type plungers. In drips 100 having 21-to-22 inches of vacuum, experiments showed that it is mandatory for lower plunger portion 94 to be an elastomeric cup-type plunger and preferably a positive seal ring-type plunger.

A standard pump 54 might prove adequate in some drips 100 that are on positive pressure. In other drips 100, a gas vent pump 54, which includes a pump barrel 72 having vent ports 88 (see FIGS. 3 & 4), may be needed due to vacuum lock between the standing valve 76 and traveling valve 82 of a standard pump 54. As explained in my U.S. Patent Application No. 60/562,207, at the top of each upstroke of pump 54 the compression in the chamber of pump 54 equalizes with conditions existing in drip 100. Fluid flows readily into pump 54 and is displaced on the downstroke. Because of the relative shallow depths of most drips 100, only one travelling valve 82 may be required in the gas vent pump 54. In high vacuum applications, the vent hole 94 in plunger 92, if used, preferably aligns with vent ports 88 at the bottom of the downstroke of gas vent pump 54. In addition, a second travelling valve 84 may be required.

Returning to FIGS. 1 and 2, drip 100 may be a horizontal drip or a vertical drip. In a preferred embodiment, drip 100 is interspersed between a downstream and upstream portion of pipeline P. The upstream portion is connected to an inlet end 102 and the downstream portion is connected to an outlet end 104 of drip 100. In another preferred embodiment, a low point 106 of the pipeline P where fluid (high gravity condensate and water) settles is tapped into and connected by way of piping 108 to inlet end 102 of drip 100.

The high gravity condensate and water being pumped from drip 100 by pump 54 enters a tee fitting 16 and is delivered under pressure to a collection vessel 66. Collection vessel 66 is preferably a Y-grade pressure tank that includes a back pressure valve 68 and a return line 70 to pipeline P. Any suitable collection vessel, however, may be used for collection vessel 66. Collection vessel 66 may employ separation methods well-known in the art for separating the water from the high gravity condensate. Positive pressure means may be used to transport the separated water components to a water tank 36 for storage and further processing.

Figure 3A:
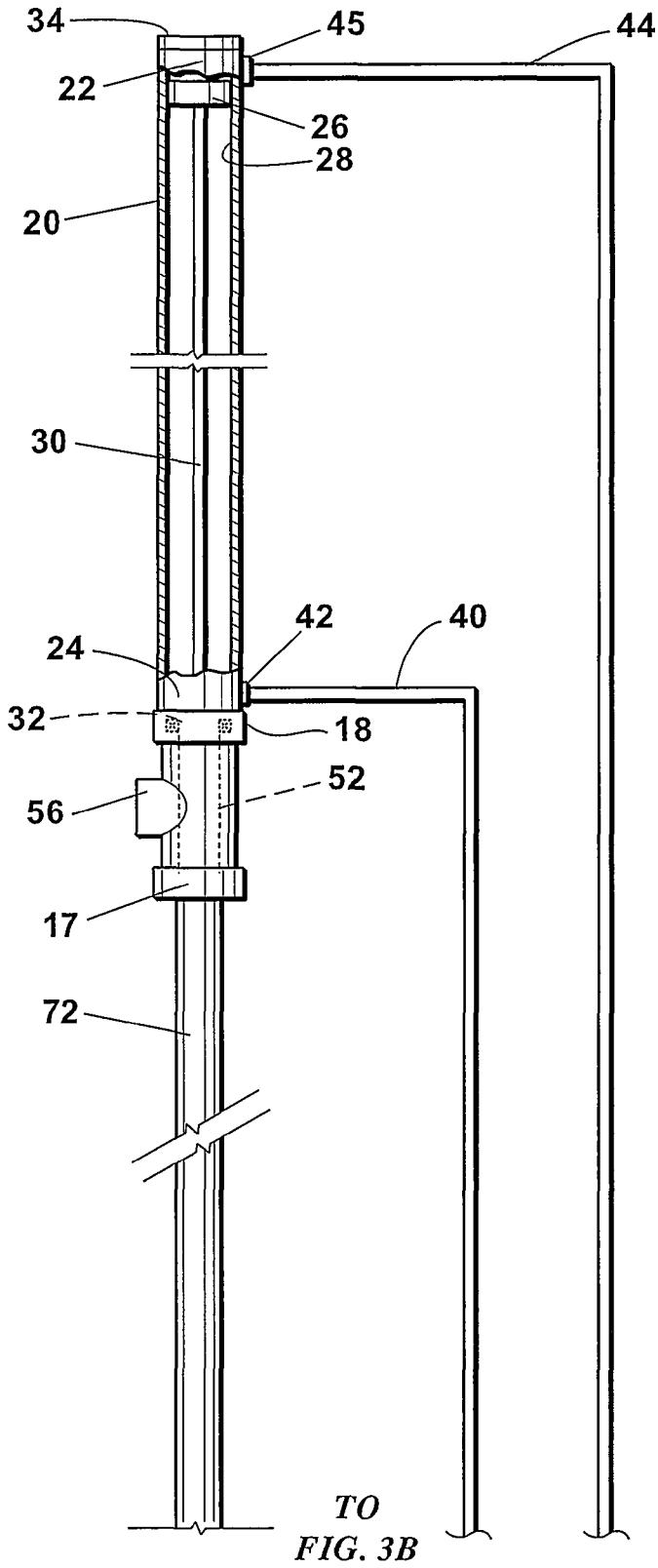
FIGS. 3A and 3B are a view of the pumping system in which a ball valve is connected above the pumping tee and the stuffing box is screwed into the ball valve. When the pump pulled, the ball valve may be closed prior to clearing the stuffing box and the pumping system does not have to be shutdown if repairs are needed.
Figure 3B:
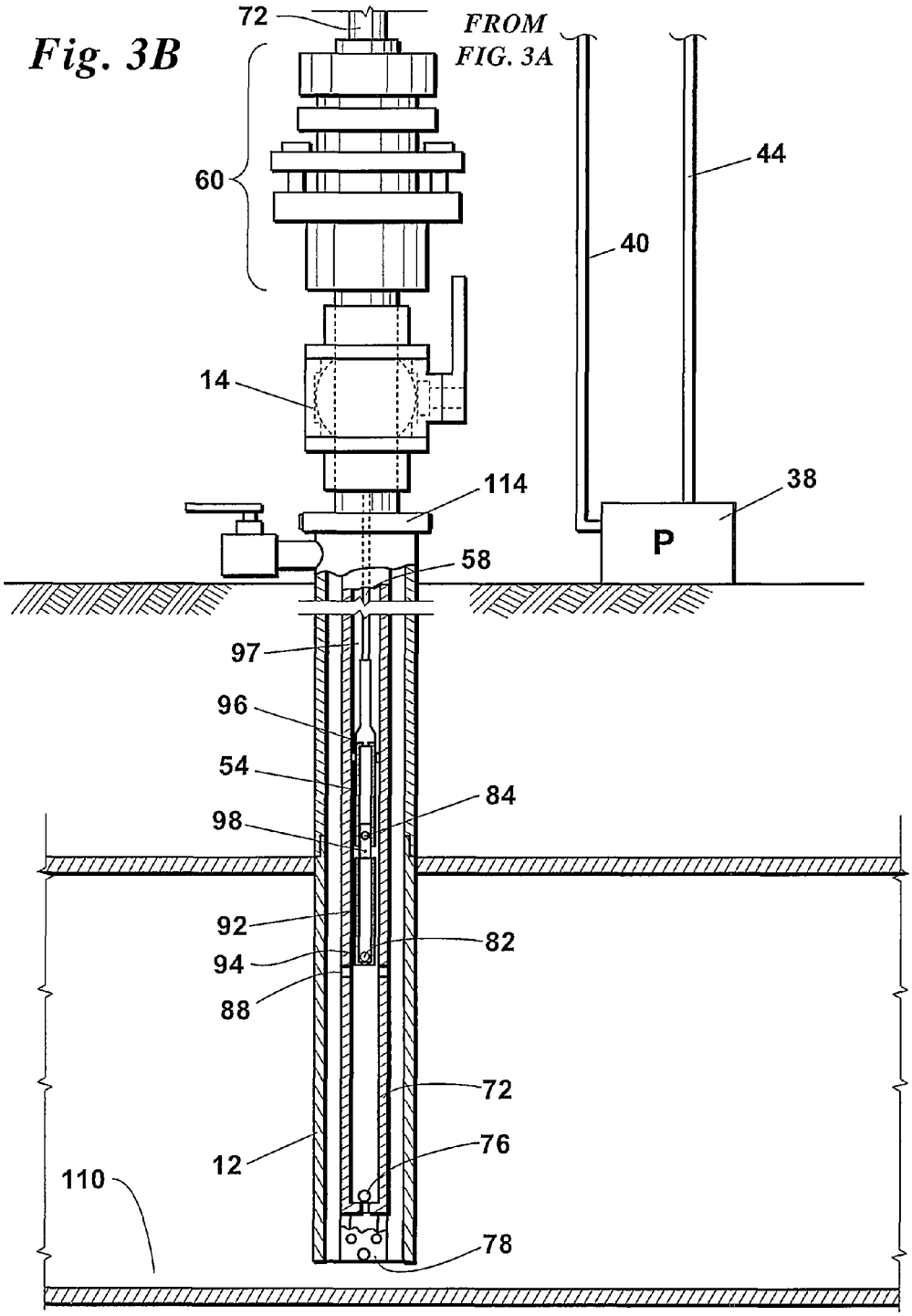
Figure 4A:
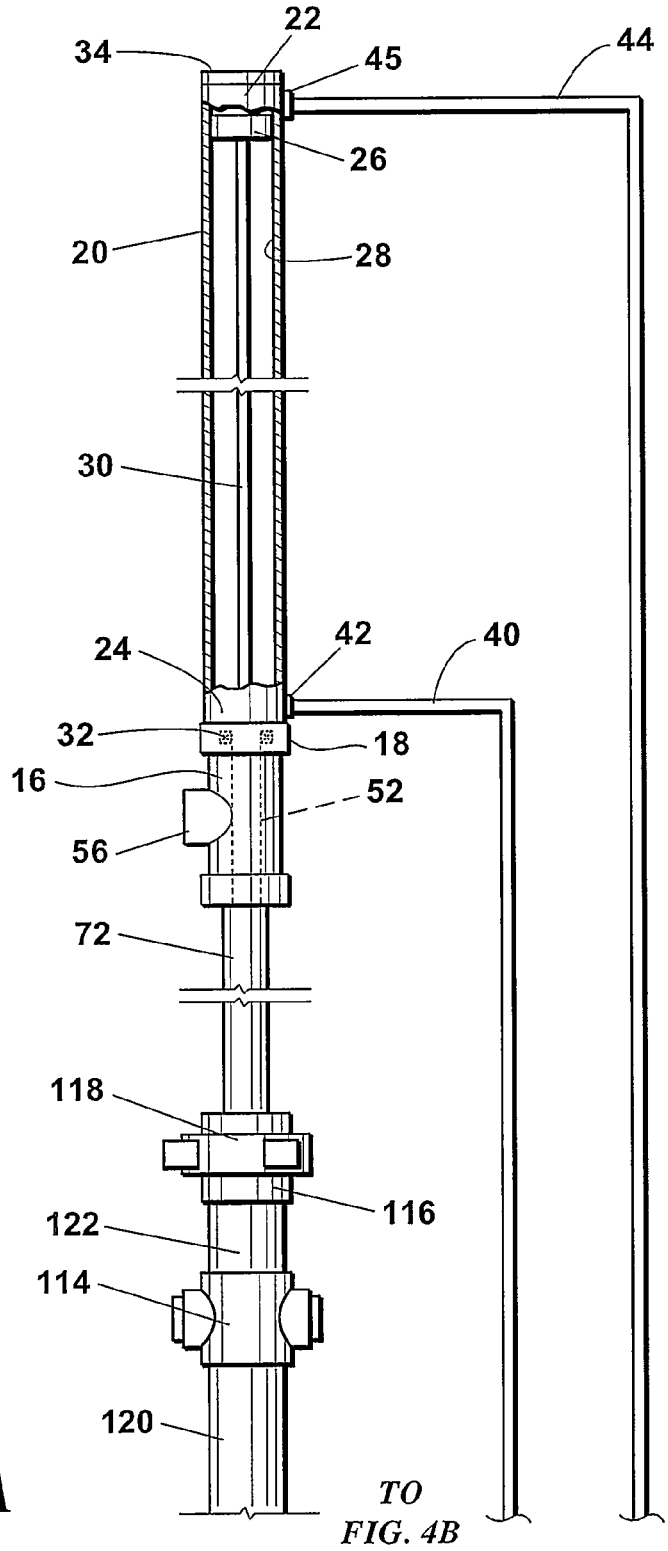
FIGS. 4A and 4B are a view of a stuffing box-free pumping system. To ensure that the straining nipple tags the bottom of the pump, the pump barrel and piping must be cut to exact length pipe.
Figures 4A, 4B:
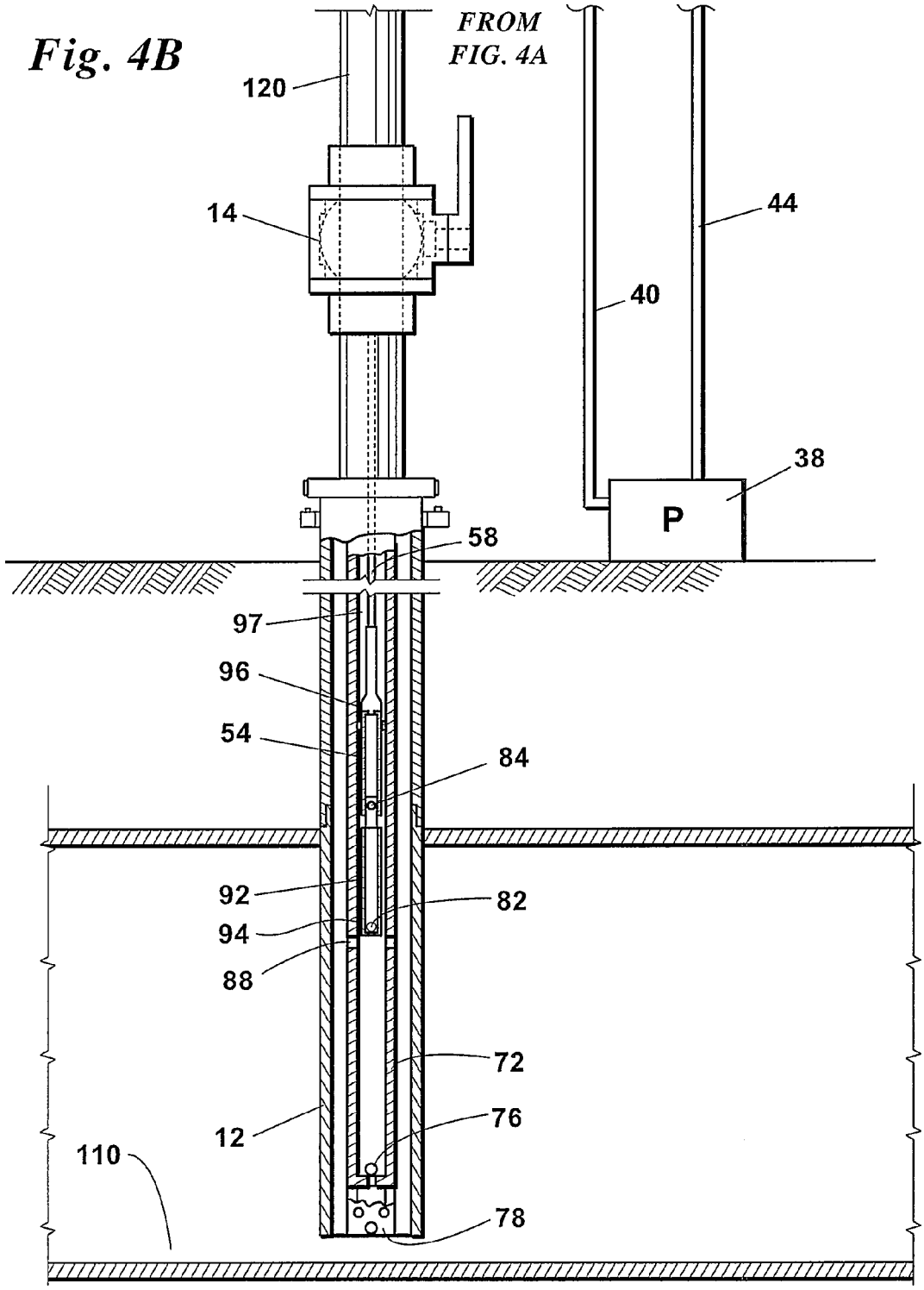

Referring to FIGS. 3 and 4, tee fitting 16, thread adaptor 17, and end gland seal member 32 may be affixed to pump barrel 72 (see FIG. 3). Tee fitting 16 has a vertical through passageway 52 and a side opening 56. Tee fitting 16 is preferably a male or female threaded pump barrel coupling connecting stroke actuator cylinder 20 directly to pump barrel 72. A threaded hole in the side of tee fitting 16 forms side opening 56 for fluid discharge out of the upper portion of pump barrel 72 above the plunger 92 and into collection vessel 66. Seal member 32, which serves as a hydraulic end gland seal, may be incorporated into the top end 18 of tee fitting 16. Seal member 32 is designed to capture hydraulic fluid in the closed drip pumping system 10 in the event of seal failure and protect the environment. Because pump 54 is primarily designed to operate in a vacuum situation, there is a greatly reduced probability of spillage of hydrocarbons or hydraulic oil. If the seals fail, all fluids will be sucked back into drip 100.

In a preferred embodiment, a stuffing box 60 is mounted on siphon line 12 and then pump barrel 72 is inserted through siphon line 12 until the straining nipple 78 of pump 54 tags a bottom portion 110 of drip 100. Stuffing box 60 is then tightened to seal pump barrel 72 to siphon line 12 to prevent air from entering drip 100. In cases involving a 2" siphon 12, it is preferable to use a 1¾ inch stuffing box 60 and a 1½ inch pump barrel 72.

Alternately, a ball valve 14 may be screwed directly to a pumping tee 114 which, in turn, is screwed directly to siphon line 12. Valving on pumping tee 114 allows drip 100 to be sucked out or blown in a normal way if pump 54 is not working. As stated previously, drip 100 may be emptied with or without pump 54 being in siphon line 12. Stuffing box 60 is screwed into ball valve 14. Pump barrel 72 then slides through ball valve 14 and stuffing box 60. When pump 54 is pulled, ball valve 14 may be closed prior to clearing stuffing box 60 and pumping system 10 does not have to be shutdown if repairs are needed. A modified stuffing box with a clapper stop (normally used in oil wells in the event of a polished rod part) may be used as stuffing box 60 to make installation and removal simple.

Stuffing box 60 is a means to prevent air from being sucked into drip 100 from the surface and down into the space between siphon line 12 and the pump barrel 72. Stuffing box 60 also enables the use of one length of pump barrel 72 to be used and sealed at any point along the barrel 72. The portion of pump barrel 72 and stroke actuator cylinder 20 that lies above stuffing box 60 depends on the length of the pump barrel 72 relative to the depth of drip 100.

In another preferred embodiment, to accomplish sealing integrity to the siphon line 12, a half union 116 may be installed on siphon line 12 and a hammer union 118 may be attached directly to pump barrel 72. Alternately, ball valve 14 may be used in a manner similar to that as described above. The hammer union 118 confines the pumped condensate and water to the interior of pump barrel 72 and tee fitting 16. Seal member 32 precludes fluid from drip 100 from entering the hydraulic system.

Use of unions 116 and 118 eliminates the requirement for stuffing box 60. This stuffing box free arrangement and importance of seal member 32 is described in further detail in my U.S. patent application Ser. No. 11/103,067, filed on Apr. 11, 2005. The hammer union attachment method, however, is not adjustable. The pump barrel 72 and piping (e.g., nipples 120, 122), therefore, must be cut to an exact length (see FIGS. 4A & B).

Supported on the top 18 of tee fitting 16 and in direct connection to pump barrel 72 is the vertically positioned elongated stroke actuator cylinder 20. Cylinder 20 provides vertical reciprocation of plunger 92. Although vertical reciprocation may be accomplished by air, gas, vacuum, electric or electromagnetic linear actuator and other prime movers-such as water, antifreeze or other fluids to further reduce environmental concerns-hydraulic force is still the preferred method at this time. Cylinder 20, therefore, is preferably a hydraulic cylinder.

Hydraulic cylinder 20 has a top end 22 and a bottom end 24. A piston 26 is vertically and slideably displaceable within the internal cylindrical wall 28 of hydraulic cylinder 20. Affixed to piston 26 is a vertical, downwardly extending piston rod 30. Piston rod 30 is received into the interior of pump barrel 72. To close the bottom end 24 of hydraulic cylinder 20, a seal member 32 that slideably and sealably receives piston rod 30 is preferred. The top end 22 of hydraulic cylinder 20 receives a closure member 34 to provide sealing integrity for hydraulic cylinder 20.

Figure 5:
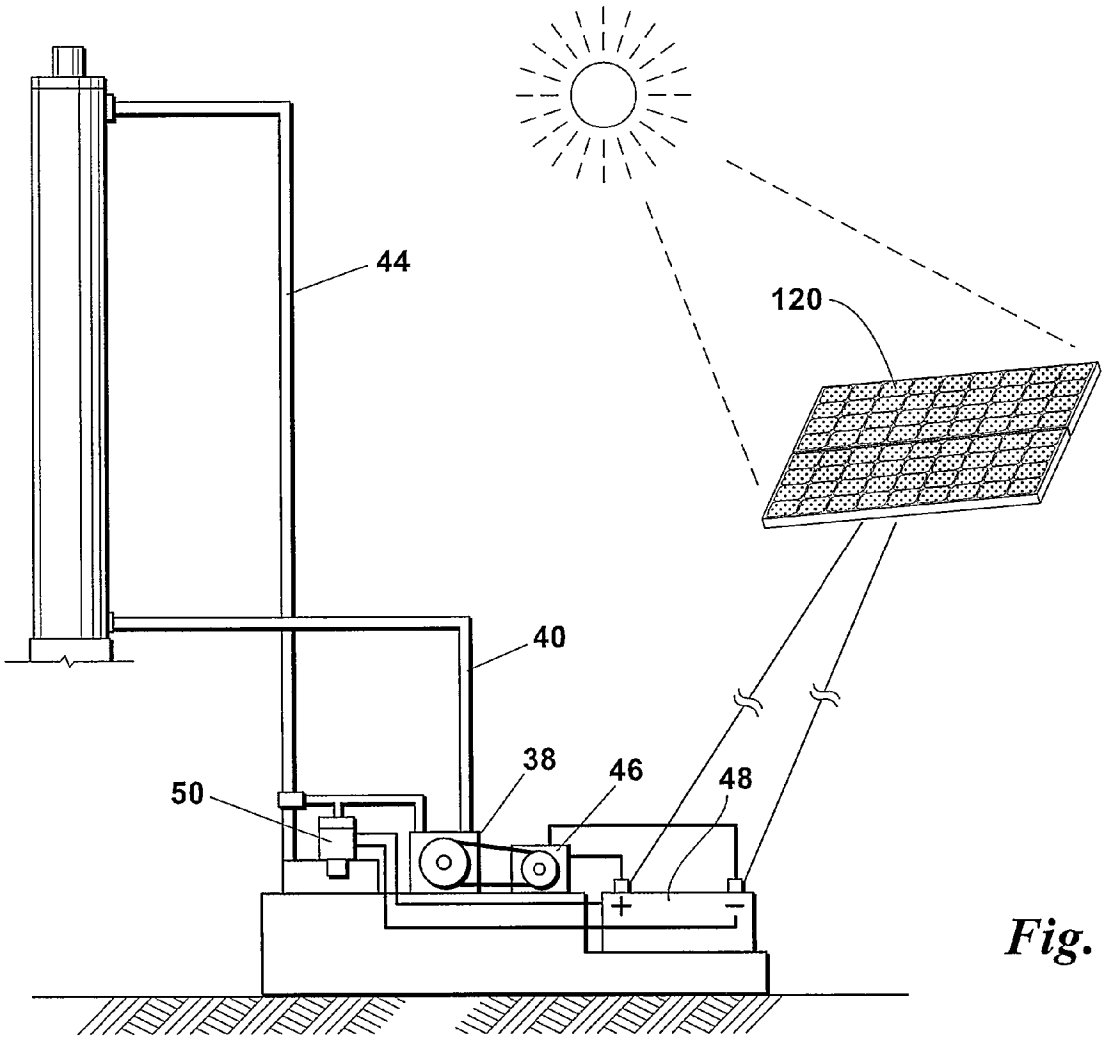
FIG. 5 is a view of a power source for the pumping system. On many remote locations solar power panels may be used as the power source. In addition, if a hydraulic cylinder is used as the stroke actuator cylinder, the hydraulic fluid pump system may include a hydraulic control.

A hydraulic fluid pump system 38 has a high pressure fluid outlet that is connected by pipe 40 to an inlet opening 42 in the cylindrical wall of hydraulic cylinder 20. Return pipe 44 connects to an outlet opening 45 in the sidewall of hydraulic cylinder 20. As shown in FIG. 5, the hydraulic fluid pump system 38 includes a prime mover 46, such as an engine or electric motor, by which pump 38 is powered. If prime mover 46 is a motor, energy may be supplied by way of a battery 48 that is representative of any other kind of electrical energy source. In addition to electric over hydraulic valves, it is also possible to reverse motor rotation when reciprocating the stroke actuator cylinder 20. By eliminating the need for electric valves, the cost to build and maintain pumping system 10 is reduced and problems and down time caused by valve failure is eliminated. On many remote locations solar power panels 112 may be used as the power source. In addition, hydraulic fluid pump system 38 may include hydraulic control 50 by which the force of hydraulic fluid applied to move piston 26 is controlled. Hydraulic control 50 may be a variable control, thereby allowing for a variable upstroke and downstroke sequence of stroke actuator cylinder 20.

Because of the relatively shallow depth of most drips 100, an adaptor 58 may be used to connect the piston rod 30 directly to the plunger 92 rather than requiring a rod string (not shown) or long pump (not shown). As stroke actuator cylinder 20 vertically reciprocates, pump 54 pumps the high gravity condensate and water upwardly from a bottom portion 110 of drip 100 within pump barrel 72. The high gravity condensate and water enter into pump barrel 72, which is in direction connection to tee fitting 16. A side opening 56 in tee fitting 16 provides a way of channeling the pumped condensate and water to a collection line 64 in communication with collection vessel 66. A valve and gauge 62 may be used to monitor and check the action of pump 54 and the flow of condensate and water into collection line 64.

In a test application of pumping system 10, a pumping system 10 was installed on a Pioneer Natural Resources' (PNR) drip located in the Panhandle West fields. This particular drip represented a difficult application—an increase of well backpressure, caused by the drip filling with fluid of 3 inches less vacuum, caused a loss of 100 mcf per day—and PNR had been on a 5-year project focused on improved methods of removing fluid from this drip. Pumping system 10 was applied and it removed the high gravity condensate and water from the drip under previously impossible pumping conditions. Compressed air was the most available prime mover and a vent pump 54 was able to accomplish fluid loading at 18.5 inches of vacuum and reach approximately 800 psi discharge pressure with about 68 psi air pressure on the stroke actuator cylinder 20. The test proved that pumping system 10 is capable and readily available to solve the existing problems mentioned in the background section of this application, as well as provide an improved method of removing fluid from pipelines. This method includes elimination of critical environmental and clean air issues as well as waste of natural resources which could lead to State mandatory installation rules.

Pumping system 10 allows for drips 100 to be pumped directly into low pressure collection vessels 66. More importantly, drips 100 can be pumped into surface pressurized tanks 66 and the water can be removed by positive tank pressure into normal water tanks 36 with no gas lost to atmosphere. The pure Y-Grade product can be stored and loaded by liquefied petroleum gas trucks with no loss to atmosphere during the trucking process.

Pumping system 10 may be employed to pump drips 100 without any lost production time. Field production may 100 be increased by keeping drips pumped out and gathering line pressure constant on the entire field. In many applications, drips can be pumped directly from gathering lines in close proximity to gas discharge lines or oil flow lines, even at high pressures. Where paraffin in oil flow lines and low gravity oil is involved, pumping system 10 will help keep flow lines clear or reduce pressure problems. A hole digger (not shown) may be used to quickly install a vertical drip 100.

While pumping system 10 has been described with a certain degree of particularity, many changes may be made in the details of construction and the arrangement of components without departing from the spirit and scope of this disclosure. The pumping system, therefore, is not limited to the embodiments set forth herein for purposes of exemplification, but is to be limited only by the scope of the attached claim or claims, including the fall range of equivalency to which each element thereof is entitled.

What is claimed is:

1. A system for pumping fluid out of an underground drip comprising:

a pump barrel housing a plunger, the pump barrel having at least one vent port, the plunger having at least one vent hole;

an elongated stroke actuator cylinder connected to said pump barrel and in alignment therewith and having a displaceable piston therein;

a piston rod affixed to said piston and in communication with said plunger;

a collection vessel in fluid communication with said pump barrel;

wherein the underground drip is a vessel designed to catch and hold fluids which drop out of natural gas during transportation through pipelines, the underground drip receiving said pump barrel, the fluid flowing upwardly under pressure created by said plunger and through a passageway formed by said pump barrel and into said collection vessel.

2. A system according to claim 1 further comprising said stroke actuator cylinder being selected from the group consisting of a hydraulic cylinder, an air cylinder, a vacuum cylinder, an electric cylinder, and an electromagnetic cylinder.

3. A system according to claim 1 further comprising said stroke actuator cylinder having a seal member affixed to a lower end of said cylinder for sealably and reciprocally receiving said piston rod.

4. A system according to claim 1 further comprising a stuffing box.

5. A system according to claim 1 further comprising said at least one vent port being located at a point where said pump barrel is emerged in the fluid.

6. A system according to claim 1 further comprising said plunger having one or more traveling valves.

7. A system according to claim 1 further comprising said plunger being selected from the group consisting of a metal plunger, a elastomeric cup plunger, and a positive seal ring plunger.

8. A system according to claim 1 further comprising a thread adaptor in communication with said pump barrel.

9. A system according to claim 1 further comprising said collection vessel being selected from the group consisting of a low pressure tank and a surface pressurized tank.

10. A system according to claim 1 further comprising said collection tank having a vapor return line in communication with the underground drip.

11. A system according to claim 1 further comprising a water collection tank in communication with said collection vessel.

12. A system according to claim 1 further comprising a siphon line, said pump barrel being located within a portion of said siphon line.

13. A system according to claim 12 further comprising a ball valve, said ball valve capable of receiving said pump barrel therethrough and sealably closing access to an upper end of said siphon line.

14. A system according to claim 13 further comprising a tee having a valve, said tee located below said ball valve.

15. A system according to claim 1 further comprising the underground drip having a positive pressure.

16. A system according to claim 1 further comprising the underground drip having a vacuum within.

17. A system according to claim 1 further comprising the connection between said stroke actuator and said pump barrel being a pump barrel connector located between said stroke actuator cylinder and said pump barrel and having a side opening and a vertical passageway therethrough that reciprocally receives said piston rod.

* * * * *